US011602680B1

(12) United States Patent
Ellington et al.

(10) Patent No.: US 11,602,680 B1
(45) Date of Patent: Mar. 14, 2023

(54) BALL BAT WITH HANDLE HAVING LIGHTENING STRUCTURES

(71) Applicant: Baden Sports, Inc., Renton, WA (US)

(72) Inventors: Blair J. Ellington, Redmond, WA (US); Kyle L. Hodge, Seattle, WA (US); Kaitlin Shreffler, Seattle, WA (US); Brent Weidenbach, Seattle, WA (US)

(73) Assignee: Baden Sports, Inc., Kent, WA (US)

( * ) Notice: Subject to any disclaimer, the term of this patent is extended or adjusted under 35 U.S.C. 154(b) by 294 days.

(21) Appl. No.: 16/928,957

(22) Filed: Jul. 14, 2020

Related U.S. Application Data

(60) Provisional application No. 62/903,641, filed on Sep. 20, 2019.

(51) Int. Cl.

| | |
|---|---|
| ***A63B 59/50*** | (2015.01) |
| ***A63B 59/58*** | (2015.01) |
| *A63B 102/18* | (2015.01) |
| *A63B 60/16* | (2015.01) |

(52) U.S. Cl.
CPC ..... *A63B 59/58* (2015.10); *A63B 60/16* (2015.10); *A63B 2102/18* (2015.10)

(58) Field of Classification Search
CPC ..... A63B 59/58; A63B 59/50; A63B 59/55; A63B 59/56; A63B 60/16; A63B 2102/18
See application file for complete search history.

(56) References Cited

U.S. PATENT DOCUMENTS

| | | | |
|---|---|---|---|
| 1,026,990 | A | 5/1912 | Matson |
| 1,305,952 | A | 6/1919 | Suesman |
| 1,690,312 | A | 11/1928 | Rosan |
| 2,225,839 | A | 12/1940 | Moore, Jr. |
| 2,471,610 | A | 5/1949 | Christensen |
| 2,659,605 | A | 11/1953 | Tourneau |
| 3,624,881 | A | 12/1971 | Brown et al. |
| 3,804,413 | A | 4/1974 | Hrivnak |
| 3,834,714 | A | 9/1974 | Smolinski |
| 4,000,895 | A | 1/1977 | Scott, Jr. et al. |
| 4,131,981 | A | 1/1979 | Scott et al. |
| 4,177,989 | A | 12/1979 | Easton et al. |
| 4,691,387 | A | 9/1987 | Lopez |
| 4,768,785 | A | 9/1988 | Patterson |
| 5,011,145 | A | 4/1991 | Bartkowicz |
| 5,035,428 | A | 7/1991 | Bartkowicz |
| 5,180,163 | A | 1/1993 | Lanctot et al. |
| 5,238,246 | A | 8/1993 | Erb |
| 5,259,610 | A | 11/1993 | Erb |
| 5,322,286 | A | 6/1994 | Frost |

(Continued)

*Primary Examiner* — Raleigh W Chiu
(74) *Attorney, Agent, or Firm* — Lowe Graham Jones PLLC

(57) ABSTRACT

A ball bat includes a handle portion with a handle secured in a sleeve in the handle portion. A void is defined within the knob and is not occupied by nor positioned within handle. The void may be defined by a gap between an end of the handle and a base of a sleeve. The gap may be defined by a smaller diameter opening, ribs (integral or separate insert), or protrusions. A void may be defined between an end of the knob and a base of the sleeve and may be occupied by stiffening ribs. The knob may be formed of two parts aligned using one or both of a pin and a locking tab. Parts of the knob extending outwardly from the sleeve may also include a void.

20 Claims, 17 Drawing Sheets

(56) References Cited

U.S. PATENT DOCUMENTS

| | | | | |
|---|---|---|---|---|
| 5,342,046 | A | 8/1994 | Erb | |
| 5,362,046 | A | 11/1994 | Sims | |
| 5,380,003 | A | 1/1995 | Lanctot | |
| 5,482,270 | A | 1/1996 | Smith | |
| 5,577,722 | A | 11/1996 | Glassberg | |
| 5,588,651 | A | 12/1996 | Frost | |
| 5,593,158 | A | 1/1997 | Filice et al. | |
| 5,611,533 | A | 3/1997 | Williams | |
| 5,624,114 | A | 4/1997 | Kelsey | |
| 5,655,980 | A | 8/1997 | Nashif et al. | |
| 5,692,971 | A | 12/1997 | Williams | |
| 5,704,845 | A | 1/1998 | Boyte | |
| 5,759,113 | A | 6/1998 | Lai et al. | |
| 5,772,541 | A | 6/1998 | Buiatti | |
| 5,839,983 | A | 11/1998 | Kramer | |
| 5,937,843 | A | 8/1999 | Troncoso | |
| 5,944,617 | A | 8/1999 | Falone et al. | |
| 5,964,672 | A | 10/1999 | Bianchi | |
| 6,007,439 | A | 12/1999 | MacKay, Jr. | |
| 6,022,281 | A | 2/2000 | Nolan | |
| 6,042,485 | A | 3/2000 | Cheng | |
| 6,045,467 | A | 4/2000 | Anderson | |
| 6,059,675 | A | 5/2000 | Finn | |
| 6,077,178 | A | 6/2000 | Brandt | |
| 6,117,028 | A | 9/2000 | You | |
| 6,159,115 | A | 12/2000 | Hsu | |
| 6,257,220 | B1 | 7/2001 | McPherson et al. | |
| 6,260,198 | B1 | 7/2001 | LoMedico | |
| 6,277,040 | B1 | 8/2001 | Randolph | |
| 6,389,596 | B2 | 5/2002 | LoMedico | |
| 6,406,387 | B1 | 6/2002 | Ryan | |
| 6,427,246 | B1 | 8/2002 | Doi et al. | |
| 6,443,860 | B1 | 9/2002 | Byrne et al. | |
| 6,709,352 | B1 | 3/2004 | Albin | |
| 6,752,731 | B1 | 6/2004 | Kramer | |
| 6,799,329 | B2 | 10/2004 | LoMedico | |
| 6,863,628 | B1 | 3/2005 | Brandt | |
| 6,932,727 | B2 | 8/2005 | Kramer | |
| 6,996,849 | B2 | 2/2006 | LoMedico | |
| 7,115,054 | B2 | 10/2006 | Giannetti et al. | |
| 7,220,195 | B1 | 5/2007 | Cronin | |
| 7,399,235 | B2 | 7/2008 | Gill et al. | |
| 7,416,499 | B2 | 8/2008 | Tucker, Sr. | |
| 7,484,248 | B2 | 2/2009 | LoMedico | |
| 7,572,198 | B2 | 8/2009 | Bleecker | |
| 7,618,336 | B2 | 11/2009 | Tucker, Sr. | |
| 7,878,930 | B2 | 2/2011 | Leinert | |
| 8,066,594 | B2 | 11/2011 | Leinert | |
| 8,083,620 | B2 | 12/2011 | Sims et al. | |
| 8,092,323 | B2 | 1/2012 | Rigoli | |
| 8,167,744 | B2 | 5/2012 | Silvain et al. | |
| 8,182,361 | B2 | 5/2012 | Gill | |
| 8,323,131 | B2 | 12/2012 | Leinert | |
| 8,371,956 | B2 | 2/2013 | Walls | |
| 8,801,551 | B2 | 8/2014 | Leinert | |
| 9,101,810 | B2 | 8/2015 | Carlson et al. | |
| 9,155,951 | B2 | 10/2015 | Ahern | |
| 9,242,155 | B1 * | 1/2016 | Lindsay | A63B 60/42 |
| 9,248,355 | B2 | 2/2016 | Long et al. | |
| 9,308,424 | B2 | 4/2016 | Thurman et al. | |
| 9,463,363 | B2 | 10/2016 | Dingman et al. | |
| 9,586,111 | B2 | 3/2017 | Long et al. | |
| 9,700,776 | B2 | 7/2017 | Shocklee et al. | |
| 10,076,693 | B2 | 9/2018 | Long et al. | |
| 10,625,128 | B2 | 4/2020 | Stenzler et al. | |
| 10,898,772 | B2 | 1/2021 | Phelan, Jr. | |
| 2003/0013563 | A1 | 1/2003 | Ryan | |
| 2003/0144089 | A1 | 7/2003 | Ryan | |
| 2004/0048696 | A1 | 3/2004 | Ciesar et al. | |
| 2004/0224804 | A1 | 11/2004 | Estape et al. | |
| 2005/0272537 | A1 | 12/2005 | Kramer | |
| 2008/0085792 | A1 | 4/2008 | Sims et al. | |
| 2008/0220914 | A1 | 9/2008 | Shaw et al. | |
| 2009/0131206 | A1 * | 5/2009 | Leinert | A63B 60/10 473/564 |
| 2009/0312125 | A1 | 12/2009 | Kearns | |
| 2012/0135826 | A1 | 5/2012 | Carlson et al. | |
| 2013/0036528 | A1 | 2/2013 | Wilson | |
| 2013/0196769 | A1 | 8/2013 | Shocklee | |
| 2014/0274491 | A1 | 9/2014 | Long et al. | |
| 2014/0274497 | A1 | 9/2014 | Long et al. | |
| 2015/0157909 | A1 | 6/2015 | Van Nguyen | |
| 2017/0106261 | A1 | 4/2017 | DePaoli et al. | |
| 2017/0106262 | A1 | 4/2017 | Long et al. | |
| 2018/0361215 | A1 | 12/2018 | Van Nguyen et al. | |
| 2019/0022483 | A1 * | 1/2019 | Chauvin | A63B 59/50 |
| 2019/0240553 | A1 * | 8/2019 | Fukae | A63B 60/02 |

* cited by examiner

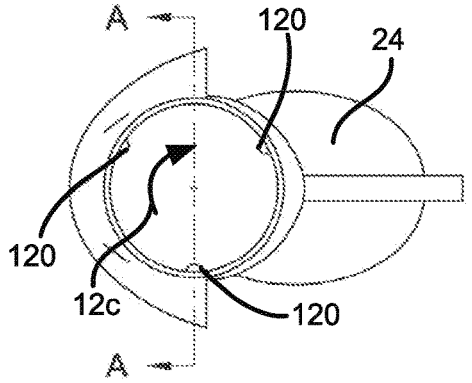
Fig. 6A
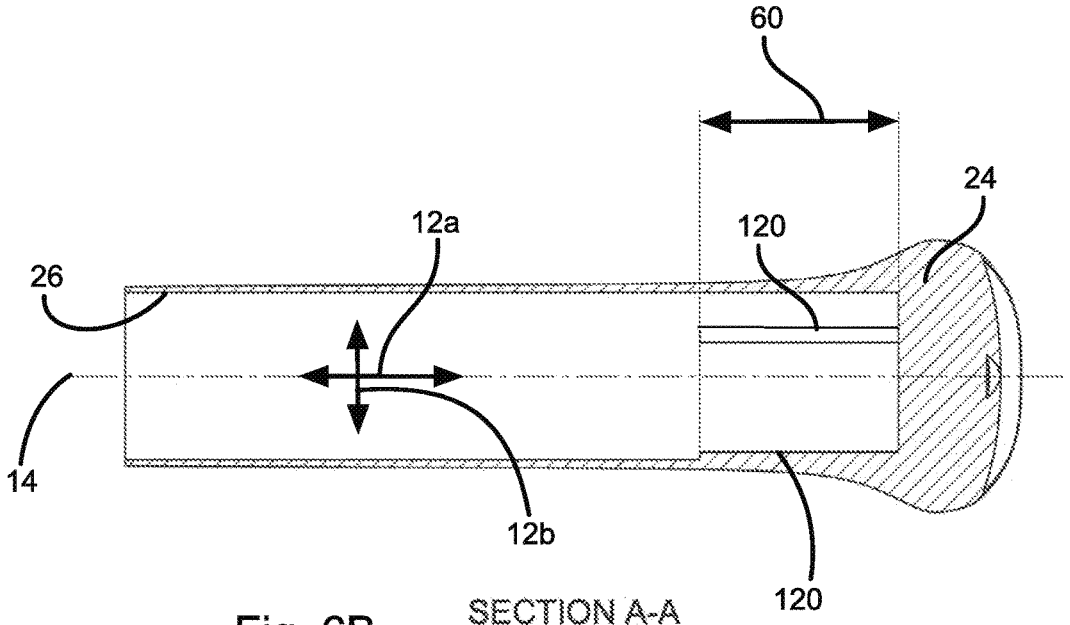
Fig. 6B SECTION A-A

BALL BAT WITH HANDLE HAVING LIGHTENING STRUCTURES

FIELD OF THE INVENTION

This application relates to ball bats and, more specifically, to handles and knobs for baseball bats.

BACKGROUND OF THE INVENTION

Many modern baseball and softball bats are made from composite material, metal alloy, or a combination thereof. In order to meet weight and weight balance requirements, bats are generally tubular and hollow. The baseball bat includes an elongated tubular body, having a barrel portion, a handle portion, a tapered mid-section portion that connects the barrel portion to the handle portion, a knob, and an endcap. The barrel portion and handle portion can either be two separate components that are then connected, or one single body component. Baseball and softball bats have conventionally included a knob located at the proximal end of the ball bat assembly. This knob is used to terminate the handle portion of the ball bat assembly. The primary purpose of the knob is to reduce the risk of the bat being thrown from a player's hands during a swing.

Traditional knobs generally have a circular configuration extending circumferentially about the end of the handle region. Knobs are traditionally fixed to the handle portion of the ball bat assembly by either being integrally formed with the handle, a knob component being welded onto the proximal end of the handle, or with a plug extending longitudinally from the knob, which is then press fit or inserted into the inner diameter opening of the proximal end of the handle. The plug can be retained in the opening by means of snap-fit connection or a mechanical locking mechanism like a pin or rivet. Other mechanical methods have traditionally been used to connect the circular configuration to the handle end of the bat.

For knobs with an asymmetric design as in U.S. Pat. Nos. 7,878,930, 8,066,594, 8,323,131, and 8,801,551, the previous mentioned methods of assembly are very difficult to utilize in the assembly of the knob. Since the knob portion is asymmetric in shape, an alternative method of manufacturing is used to affix the knob to the proximal end of the handle. The non-circular cross section of the handle and knob portion requires a portion of proximal end of the handle to also be non-circular. For this, the knob is typically formed separately from other portions of the ball bat (i.e. barrel, handle, endcap). Alternatively, the knob may be formed integrally with the rest of the bat when made as a unibody design. Example methods of manufacturing this asymmetric knob portion include injection molding, three-dimensional (3D) printing, compression molding, and resin transfer molding. Typically, these knobs are manufactured with a bore that allows for the insertion of the proximal end of the handle. The handle can then be fixed either with an adhesive, a mechanical locking mechanism like a rivet or pin, a snap fit, or with a combination of mechanisms. The handle length is modified or cut to ensure that the total length of the ball bat assembly meets the specified length requirement. With this slip-on feature of the asymmetric knob, the geometry of the asymmetric knob is preserved.

Sporting governing bodies have created and promulgated regulations to improve the safety of the sport for all its players. One regulation limits the bat-ball coefficient of restitution (BBCOR), which is the measure of bat performance by using inbound and rebound speeds of the ball to calculate the energy transfer efficiency of the bat. Another regulation limits the batted ball speed, or BBS, of the rebounded ball, which also uses the inbound and rebound speeds of the ball to calculate the energy transfer efficiency of the bat. Both methods are often described as measuring the bat's "trampoline effect" or the bat's elasticity. By limiting the bat's performance, it is believed that the game will be safer for all players. There have been several approaches used for limiting a bat's performance. Some approaches reduce bat performance by stiffening the bat so that its trampoline effect is reduced. These stiffening elements tend to increase the overall weight of the ball bat assembly. Specifically, for youth or fastpitch players, the increased weight may make the bat too heavy for the player.

SUMMARY OF THE INVENTION

In one aspect of the invention, a ball bat includes a barrel portion; a handle portion secured to the barrel portion and being concentric with the barrel portion about a central axis and having a smaller diameter than the barrel portion; and a knob secured to the handle portion. The knob includes a knob body defining an outer surface and a sleeve defined within the knob body, at least part of the handle portion being inserted within the sleeve. A void is defined within the knob body. The void is not occupied by and not positioned within the at least the part of the handle portion positioned within the sleeve.

In some embodiments, the void is positioned between a proximal end of the handle portion and a base of the sleeve along the central axis. In some embodiments, one or more ribs are positioned between the base of the sleeve and the proximal end of the handle portion. The one or more ribs may include a plurality of ribs radiating outwardly from a node positioned on the central axis. The plurality of ribs and the node may be a separate member from the knob. The knob may define a plurality of grooves extending along the sleeve parallel to the central axis, the plurality of ribs being positioned within the plurality of grooves. In some embodiments, the plurality of ribs and the node are co-molded with the knob. In some embodiments, the knob includes a plurality of protrusions extending inwardly from the sleeve only partially toward the central axis and positioned between the base of the sleeve and the proximal end of the handle portion. In some embodiments, the knob includes a smaller diameter opening defined within the knob, the smaller diameter opening having a diameter about the central axis smaller than a diameter of the sleeve and an outer diameter of the handle portion, the smaller diameter opening defining the void.

In some embodiments, the knob includes a wall defining a base of the sleeve, the wall being positioned between the void and a proximal end of the handle portion. The knob may include a first part and a second part, the first part including a first wall part defining a first void part, the second part including a second wall part defining a second void part, the first and second wall parts defining the wall and the first and second void parts defining the void.

In some embodiments, a projection extends outwardly from the first part, the second part defining an opening sized to receive the projection. The projection may be one of a pin and a locking tab. In some embodiments, a first node is positioned within the first void part and a plurality of first ribs extend outwardly from the first node to a perimeter of the first void part. A second node is positioned within the second void part and a plurality of second ribs extend outwardly from the second node to a perimeter of the second void part. In some embodiments, a pin extends outwardly form the first node, the second node defining an opening, the pin being positioned within the opening. In some embodiments, a locking tab extends outwardly from the first wall part, the second wall part defining an opening sized to engage the locking tab.

In some embodiments, the void is defined in the knob body offset from the sleeve. The knob may include a first part and a second part. The first part defines a first sleeve part and a first void part offset from one another. The second part defines a second sleeve part and a second void part offset from one another, the first sleeve part and the second sleeve part defining the sleeve and the first void part and the second void part defining the void.

In some embodiments, the knob and the barrel portion are asymmetrical about the central axis.

BRIEF DESCRIPTION OF THE DRAWINGS

Preferred and alternative examples of the present invention are described in detail below with reference to the following drawings:

FIG. 6A is a top view of a fifth lightened knob in accordance with an embodiment of the present invention;

FIG. 6B is a side cross-sectional view of the fifth lightened knob along section line AA in FIG. 6A;

FIG. 6B is a side cross-sectional view of the fifth lightened knob secured to a handle portion of a baseball bat;

DETAILED DESCRIPTION OF THE PREFERRED EMBODIMENTS

Figure 1A:
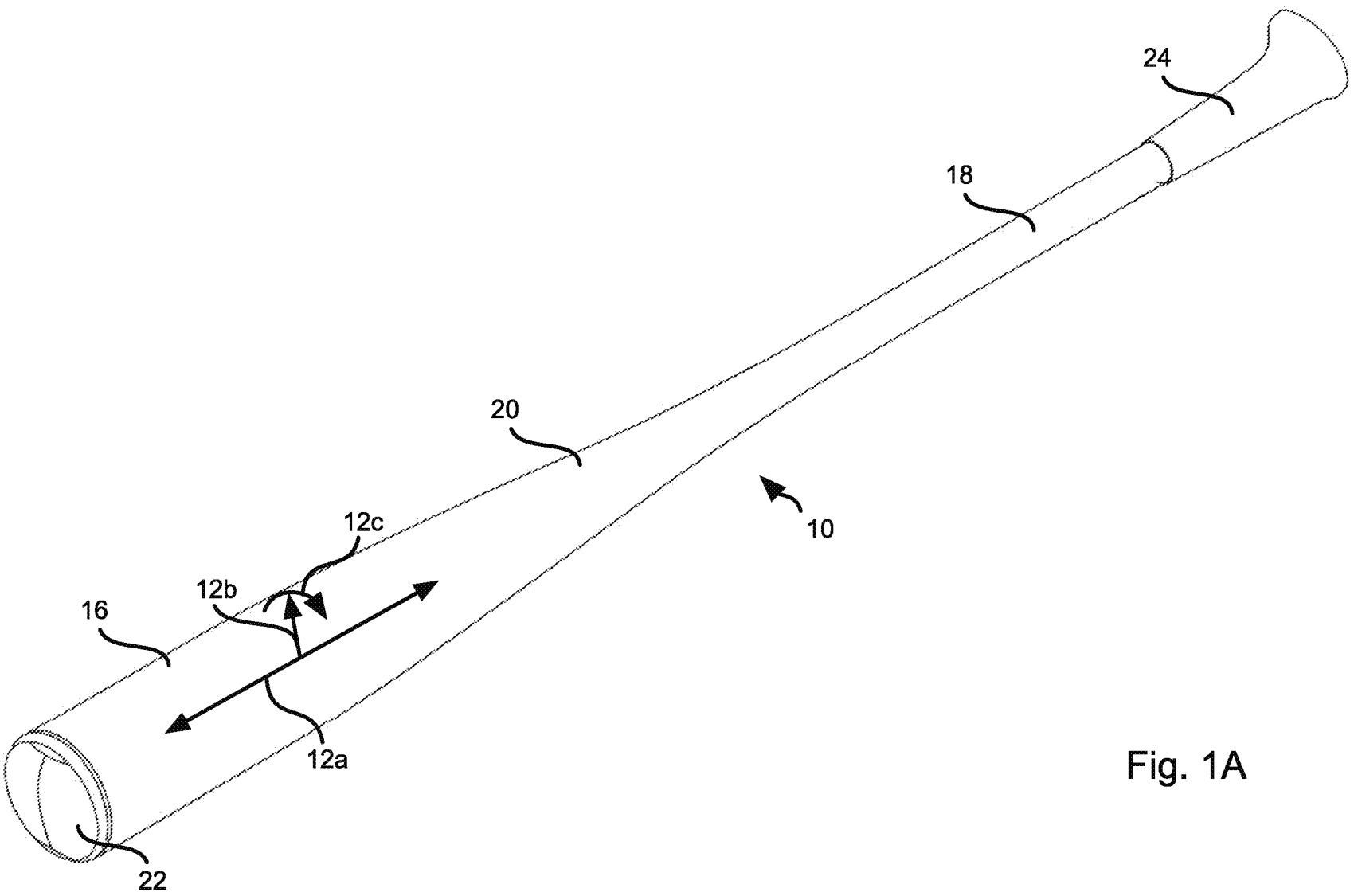
FIG. 1A illustrates is an isometric view of a baseball bat in accordance with an embodiment of the present invention.
Figure 1C:
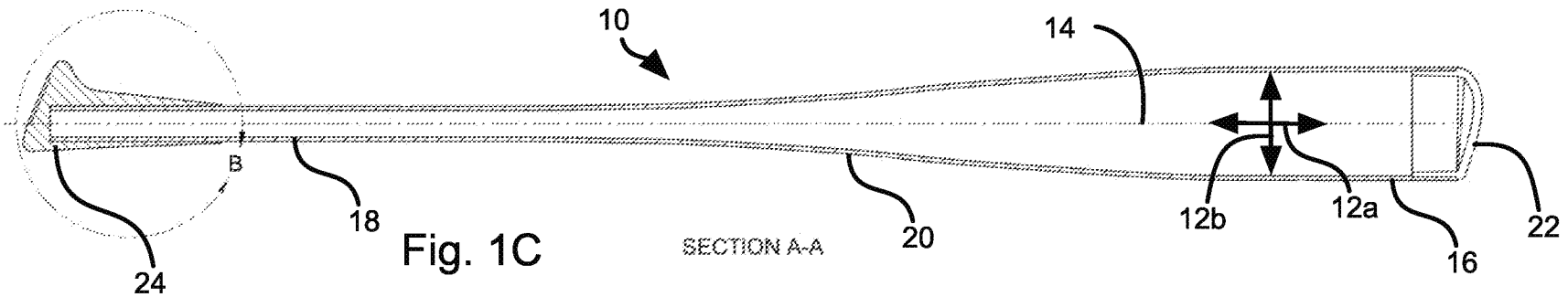
FIG. 1C is a side cross-sectional view of the baseball bat of FIGS. 1A and 1B along section line AA shown in FIG. 1B.
Figure 1B:
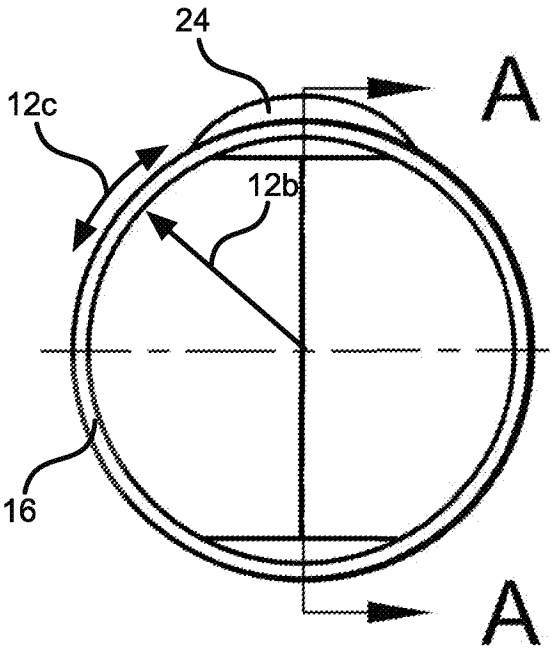
FIG. 1B is top view of the baseball bat of FIG. 1A.

For knobs with an asymmetric design, the asymmetric knob and structures used to attach it to the handle tend to increase the overall weight of the ball bat. The various embodiments of ball bats described herein may be used to reduce the overall weight of the bat assembly.

Referring to FIGS. 1A through 1E, a baseball bat 10 may be understood with respect to a longitudinal direction 12*a* and a radial direction 12*b* defined as an orientation radiating outwardly from the longitudinal direction 12*a* without regard to angle. A circumferential direction 12*c* may be defined as tangential movement or orientation about a center line parallel to the longitudinal direction 12*a* and offset from the longitudinal direction 12*a* along the radial direction 12*b*.

The baseball bat 10 may include a barrel portion 16, a handle portion 18, and a transition region 20 (i.e., the taper) between the barrel portion 16 and the handle portion 18. The barrel portion 16 and the handle portion 18 may be cylindrical about a center line 14 parallel to the longitudinal direction 12*a*, an outer diameter of the barrel portion 16 being greater, e.g. between 2 and 3 times greater, than the outer diameter of the handle portion 18. The transition region 20 may have a frustoconical shape that transitions from the greater diameter of the barrel portion 16 to the smaller diameter of the handle portion 18. Curved or rounded transitions between the barrel portion 16 and the transition portion 20 and between the handle portion 18 and the transition portion 20 may also be present. The portions 16 and 18 may be substantially cylindrical or include cylindrical and substantially cylindrical portions. For example, "substantially cylindrical" may be understood as a frustoconical shape with a cone angle of between 0 and 3 degrees.

The portions 16, 18, 20 may be monolithically formed such as by co-molding, casting, or other approach. Preferably, these components are manufactured by metal extrusion and/or composite bladder molding. The portions 16, 18, 20 may be manufactured separately and be secured to one another in the illustrated relationship by means of welds, adhesive, threaded attachment, or other fastening means. The portions 16, 18, 20 may be made of the same material or different materials and each may be any of metal, plastic, composite (e.g., carbon fiber, fiberglass, etc.), wood, or any other material suitable for withstanding the impact forces imposed on a baseball bat when striking a ball.

For example, the barrel portion 16 and handle portion 18 may be made of metal whereas some or part of the transition region 20 may include an elastomeric material, a polymer foam, an epoxy, an adhesive, a rigid polymer, or other plastic material, or any other spacer material. In another example, the barrel portion is made of a metal alloy as is the handle is made of another material such as wood, composite, or rigid plastic. In another example, the barrel portion 18 is formed of a combination of a composite material (carbon fiber composite, fiberglass composite) in combination with another material such as an aluminum alloy, titanium alloy, scandium alloy, steel, other alloys, thermoplastic material, thermoset material, wood, or other polymer matrix composite materials.

Figure 8:
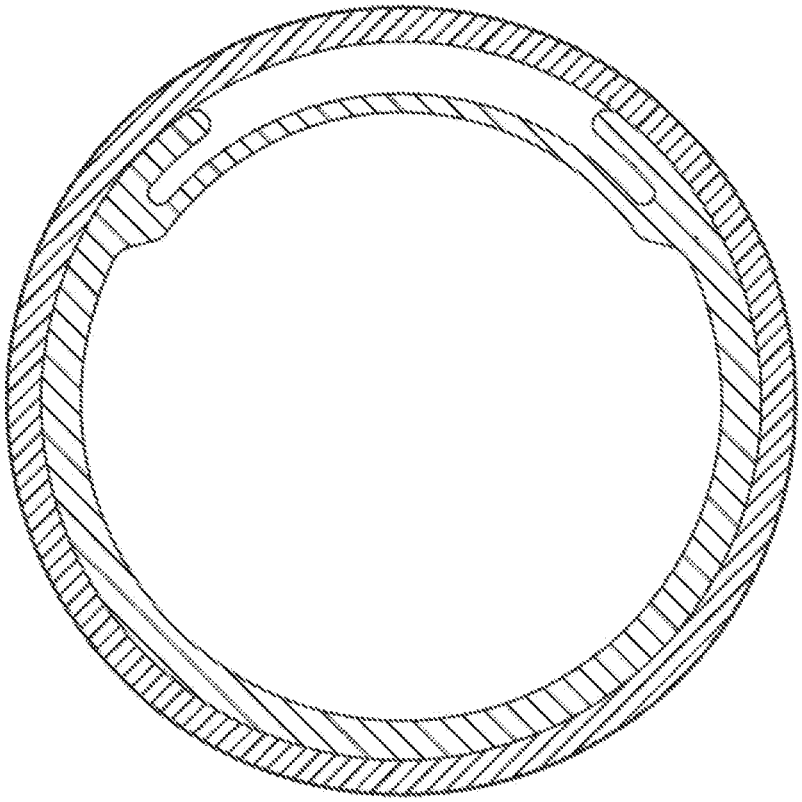
FIG. 8 is a cross-sectional view of the barrel portion of the baseball bat of FIG. 1.

The barrel portion 16 may be a hollow cylinder of uniform wall thickness and may also have non-uniform thickness or have other non-symmetrical features about the center line 14. These non-uniformities or non-symmetrical features may be according to any approach known in the art in order to enhance the performance of the baseball bat 10. Where non-uniform or non-symmetrical features are present, the barrel portion 16 may define a striking plane, i.e. a plane passing through the center line 14 and defining a plane of movement in which the barrel portion 16 and ball should be moving in in order to achieve the enhanced performance intended by the non-uniform or non-symmetrical features. The handle portion 18 may be a hollow cylinder of uniform thickness or may also be non-uniform or have non-symmetrical features. In some embodiments, the barrel portion 16 and handle portion 18 are symmetrical about the center line 14 but the thicknesses of one or both of the barrel portion 16 and the handle portion 18 vary along the center line 14. The barrel portion 16 may further include one or more inserts that may be symmetrical or non-symmetrical and that are positioned within the barrel portion 16 in order to enhance the performance of the baseball bat 10. FIG. 8 shows a cross-sectional view of the barrel portion 16 as viewed along the longitudinal direction 12*a* with the barrel portion 16 including a non-symmetrical insert to provide the barrel portion 16 with asymmetry about its central axis.

Examples of non-symmetrical barrel portions 18 and handles portions 16 that may be used to implement the barrel portion 16 and handle portion 18 in the embodiments disclosed herein are described in U.S. Pat. No. 7,878,930, which is hereby incorporated herein by reference in its entirety. Examples of inserts that may be incorporated into barrel portions of the embodiments described herein are described in U.S. Pat. No. 9,498,690, which is hereby incorporated herein by reference in its entirety.

Outer surfaces of some or all of the barrel portion 16, and handle portion 18, and transition region 20 may be anodized, coated and/or painted with one or more layers of paint, clear coat, inks, coatings, primers, and/or other outer surface coatings. Outer surfaces of some or all of the barrel portion 16, and handle portion 18, and transition region 20 may include alpha numeric and/or graphic distinguishing marks indicative of designs, trademarks, graphics, specifications, certifications, instructions, warning, and/or markings. These can include a trademark that is applied as a decal, as a screening or through other conventional means.

Figure 1D:
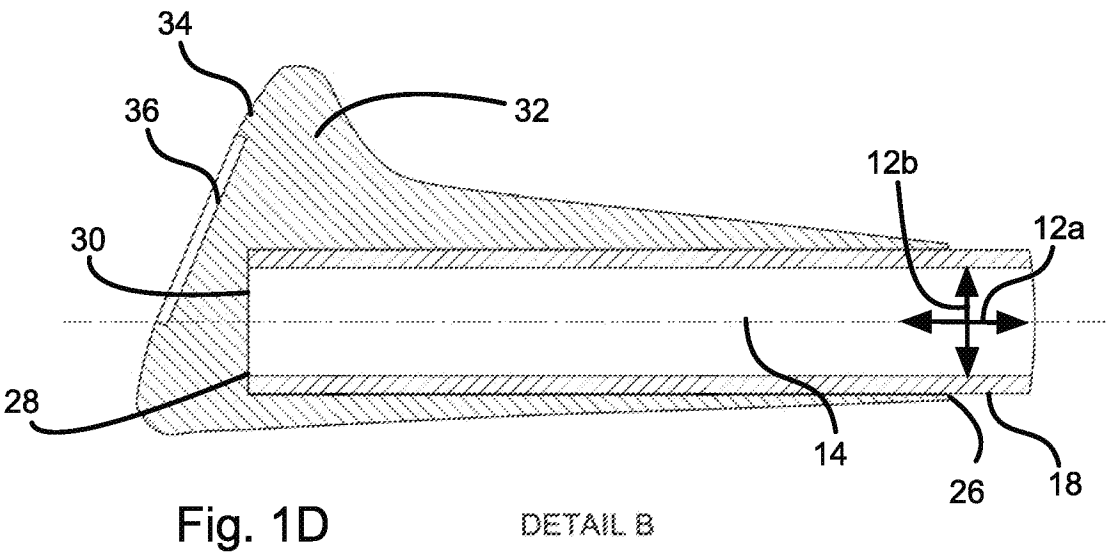
FIG. 1D is Detail B of the cross-sectional view of FIG. 1C.
Figure 1E:
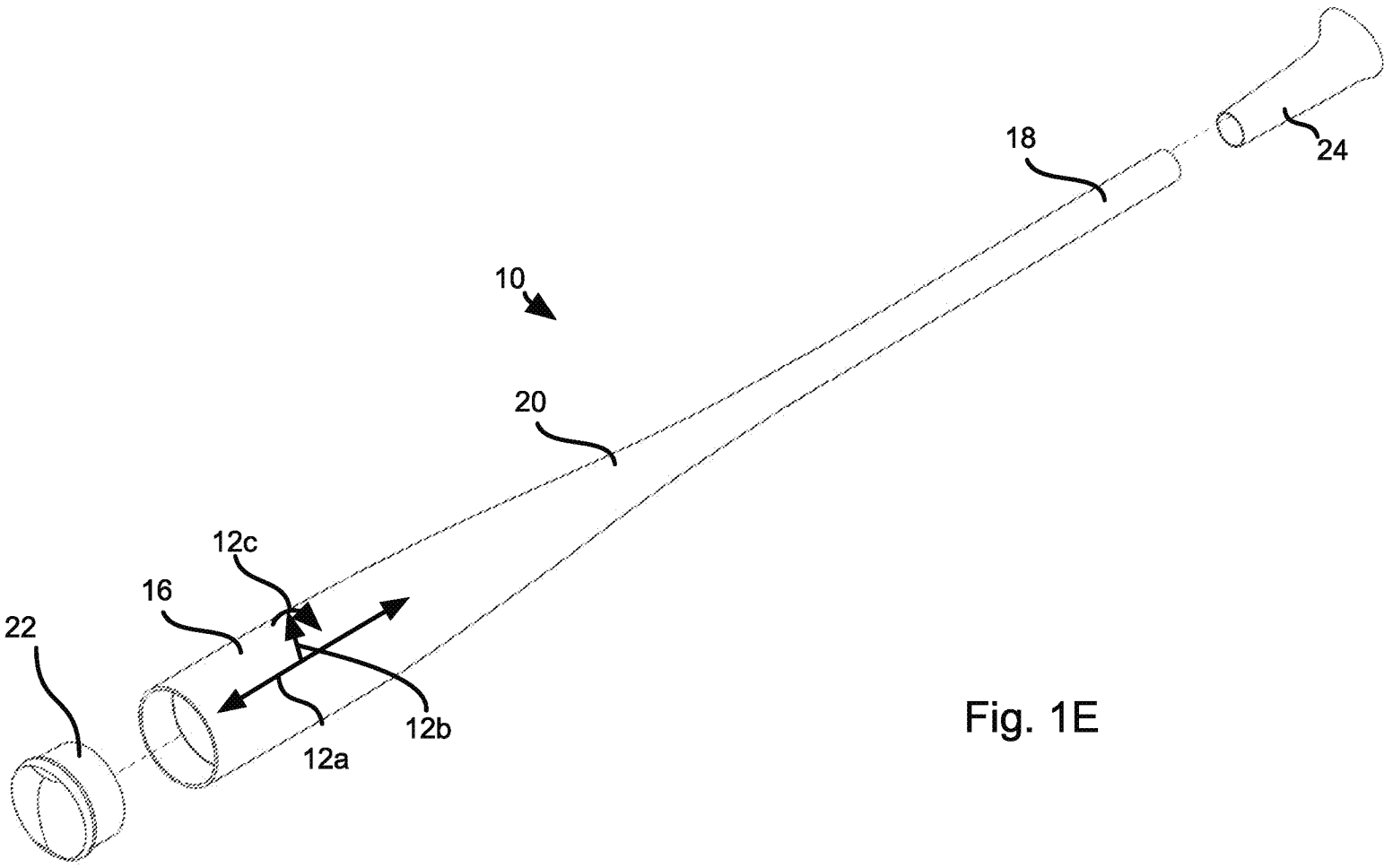
FIG. 1E is an exploded view of the baseball bat of FIG. 1A.

A knob 24 may secure to a proximal end of the handle 18 and an end cap 22 may secure to a distal end of the barrel portion 16. As shown in FIG. 1E, the end cap 22 may include a portion that slides within the distal end of the hollow barrel portion 16 and may be secured therein by means of welds, adhesive, rivets, screws, or other fastening means. In other embodiments, the barrel portion 16 is formed with a closed distal end such that a separate end cap 22 is not used.

A knob 24 may slide over a proximal end portion of the handle portion 18 and be secured by means of welds, adhesive, rivets, screws, or other fastening means. Referring specifically to FIG. 1D, the knob 24 may define a sleeve 26 sized to receive part of the handle portion 18. The sleeve 26 may be sized to receive the handle portion 18 with an interference fit such that further fastening means are not used. In other embodiments, the sleeve 26 slides freely over the handle portion 18 and is secured thereto by means of adhesives applied to one or both of the sleeve 26 and the proximal portion of the handle portion 18. The handle portion 18 may also secure within the sleeve 26 using welds, screws, rivets, or any other fastening means.

In the embodiment of FIG. 1D, the proximal end 28 of the handle portion 16 extends through the sleeve 26 to a base 30 of the sleeve 26. The knob 24 further defines a knob body 32 that protrudes outwardly from the sleeve 26 and defines a contoured outer surface, e.g. an "axe handle" in the illustrated embodiment. The contoured outer surface defined by the knob body 32 may define an end surface 34 that is angled with respect to the center line 14. The end surface 34 may define a recess 36 that may hold the "knob jewel" or a sticker indicating bat weight and length or other indicia. It may also function to lighten the knob 24.

Figure 1F:
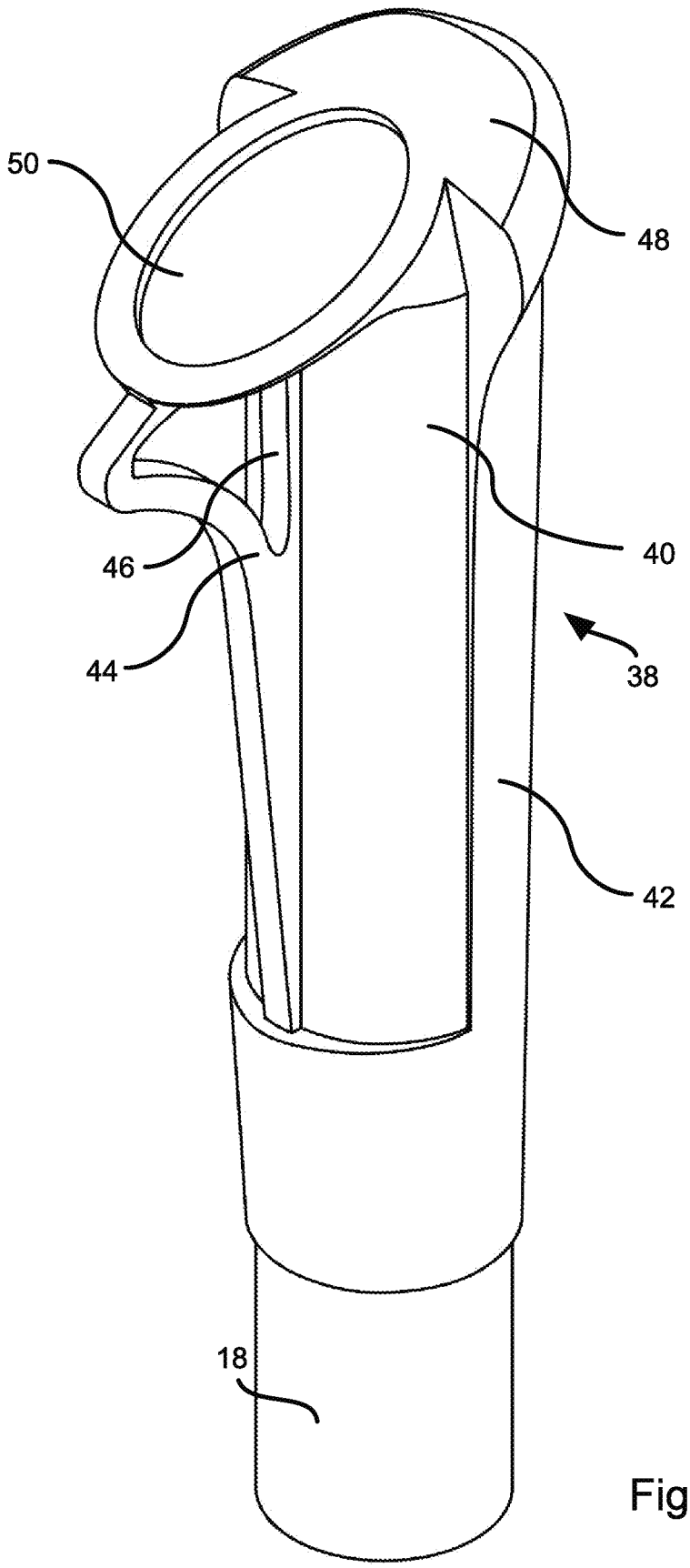
FIG. 1F is an isometric view of a frame for a knob of the baseball bat of FIG. 1A.

Referring to FIG. 1F, the knob 24 may be formed of a frame 38 made of a rigid material, such as metal, plastic, or composite. The frame 38 may be subsequently coated with a flexible polymer, such as rubber or other elastomeric plastic, composite or rubber material to achieve the shape shown in FIGS. 1A to 1E. In the illustrated embodiment, the frame 38 includes a hollow cylinder 40 sized to receive the handle portion 18, an outer contoured portion 42 that extends outwardly from the cylinder 40 and defines a portion of the outer surface of the knob 24 when completed. The contoured portion 42 may remain uncoated with the flexible polymer or be coated with a thin layer (e.g., 1-3 mm). A rib 44 may also extend outwardly from the cylinder 40, such as opposite the contoured portion 42. The rib 44 may define one or more recesses 46 for enhancing securement to the overmolded polymer. The recess locks the overmold material onto the knob. It is preferably filled with elastomer that is typically denser than the plastic material. The frame 38 may also define an end surface 48 defining a recess 50 that correspond in shape and position to the end surface 34 and recess 36. The end surface 48 and recess 50 may be uncoated by the overmolded polymer or by a thin layer of the overmolded polymer (e.g., 1-3 mm) to form the end surface 34 and recess 36.

As shown in FIGS. 1A through 1F, the knob 24 is non-symmetrical about the center line 14. In particular, the knob 24 may be the illustrated "axe handle" type knob. Accordingly, where the barrel 16 has an asymmetry, the handle portion 18 may be provided with a mark and the knob 24 may be provided with a mark. These marks may then be aligned in order that the knob 24 has a desired orientation relative to the striking plane of the barrel portion 16.

Figure 2A:
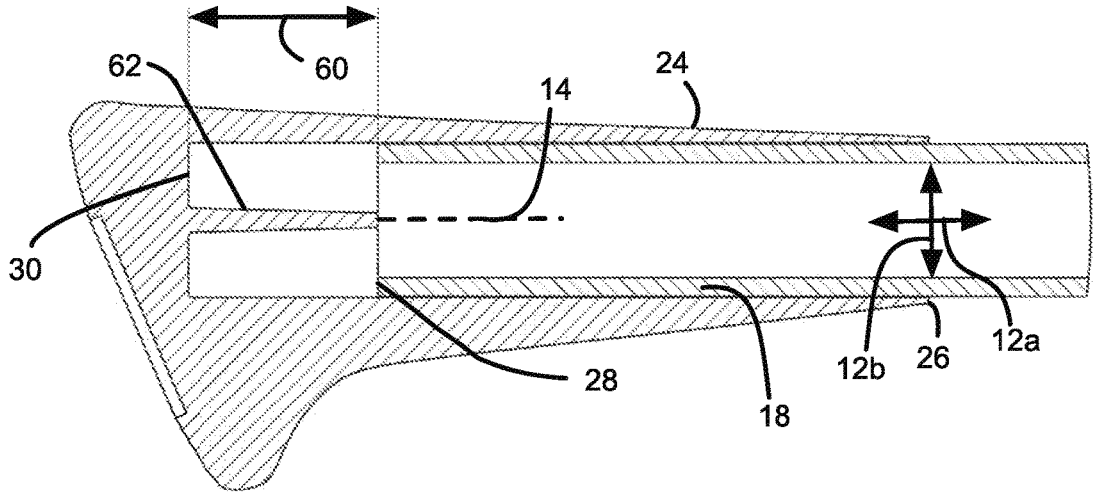
FIG. 2A is a side cross-sectional view of a lightened knob and handle portion for a baseball bat in accordance with an embodiment of the present invention.
Figure 2B:
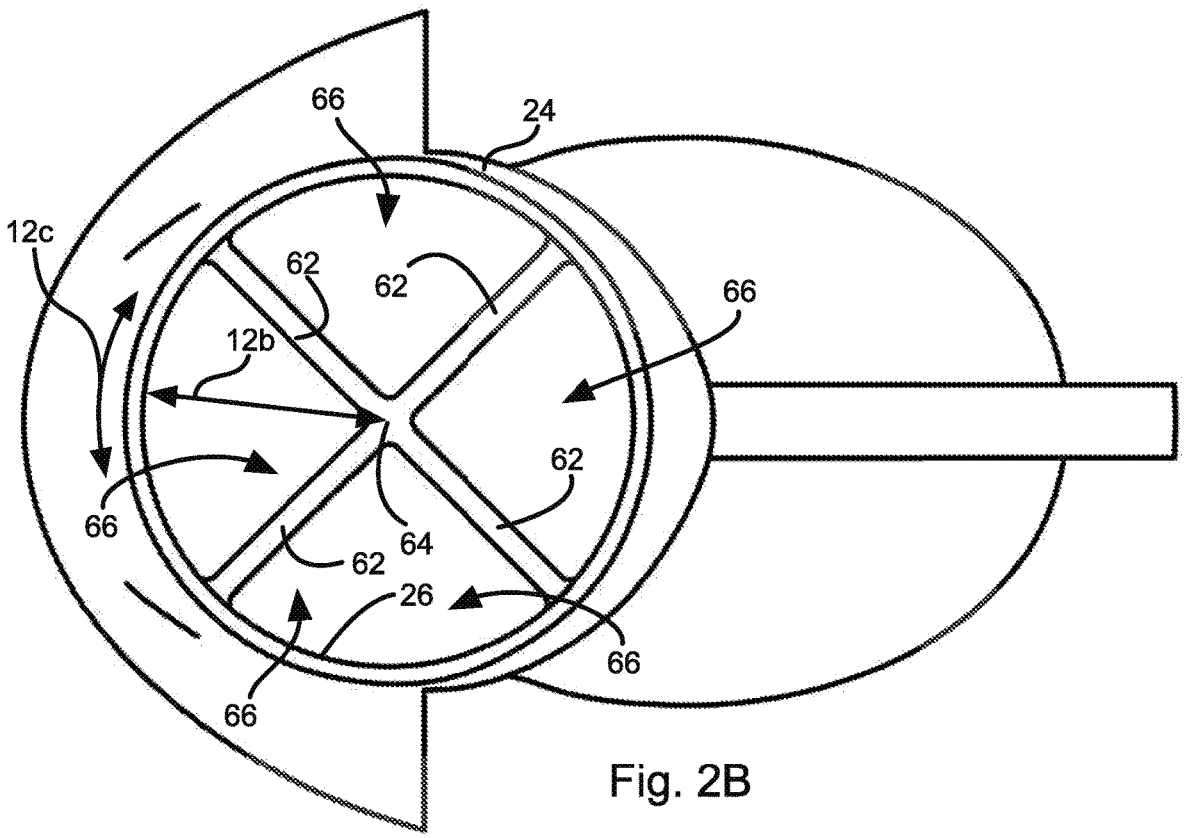
FIG. 2B is a top view of the lightened knob of FIG. 2A.

FIGS. 2A and 2B illustrate one approach for modifying the handle portion 18 and knob 24 in order to lighten the baseball bat 10. In the illustrated embodiment, the handle portion 18 is shortened by a length 60. For example, the length 60 may be from 2 to 5 cm. One or more ribs 62 extend outwardly from the base 30 of the sleeve 26 along the longitudinal direction 12*a* by an amount substantially equal to the length 60 (e.g., +/−3 percent). As shown in FIG. 2B, the ribs 62 may radiate outwardly in the radial direction 12*b* from a node 64 positioned substantially (e.g., within 1-3 mm) on the center line 14 of the handle portion 18. The node may alternatively be positioned substantially off of the center line, as desired to change the characteristics of the bat. In the illustrated embodiment, the ribs 62 are distributed uniformly about the node 64 in the circumferential direction 12*c*. In the illustrated embodiment, there are four ribs 62, however, 3, 5, 6, or other number of ribs may be used. Each rib 62 may be planar in shape with a length along the radial direction 12*b* that is much greater (e.g., at least 8 times) its thickness in the circumferential direction 12*c*. Alternatively, the ribs may be wedge shaped with thickness in the radial direction increasing with distance from the node 64, e.g., sector shaped.

The ribs 62 define voids 66 between them that may be filled with air following manufacture. In this and other embodiments disclosed hereinbelow, cavities or voids defined in the knob 24 may remain empty (air or vacuum) or be filled with a lightweight material such as a closed-cell or open-cell foam.

In the illustrated embodiment, the ribs 62 and node 64 are monolithically formed with the knob 24, such as by co-molding. The knob 24 in this and other embodiments disclosed hereinbelow may be manufactured using injection molding, compression molding, three-dimensional printing, polymer casting, CNC machining, and blow molding. Other techniques may alternatively be employed. For example, features may be incorporated into a mold used to form the knob 24 and the ribs 62. In some embodiments, the knob 24 with the ribs 62 and node 64 may be formed as a single member without requiring additional assembly.

The knob 24 in this and other embodiments disclosed hereinbelow may be made of thermoset and/or thermoplastic materials. Typical materials for this can be, but are not limited to, polyethylene terephthalate (PET), polypropylene (PP), polyvinyl chloride (PVC), polystyrene (PS), polycarbonate (PC), acrylonitrile butadiene styrene (ABS), acrylic (PMMA), polyamide (PA), polyethylene (PE), polyethylene terephthalate glycol (PETG), nylon, thermoplastic polyurethane (TPU), polylactic acid (PLA), acetal (polyoxymethylene, POM), polymethyl pentene (PMP), high impact polystyrene (HIPS). Overmolding and insert molding may be used as a secondary function to complete manufacture of the knob 24.

As is apparent, the approach of FIGS. 2A and 2B, lightens the bat 10 by reducing the size of the handle portion 18 and replacing it with voids 66 filled with air or a lightweight material. The knob 24 may be made of a lighter material than the handle portion 18 such that the addition weight of the ribs 62 and node 64 is less than the weight of a length 80 of the handle portion 18 that is omitted. For example, the knob 24 may be made of plastic whereas the handle portion 18 is made of metal.

The ribs 62 and node 64 may further function as structural elements to stiffen the knob 24 and provide stability without increasing the wall thickness of the knob 24. In U.S. Pat. No. 7,878,930, the concept of an asymmetric knob is introduced, thus also specifying a "hitting" and "non-hitting" face of a barrel portion 16 relative to the axis of the knob 24 positioned on the handle of the bat 10. The asymmetry of the knob 24 will orient the bat in one direction, causing the player to only hit the barrel portion 16 on one side during use. Despite all players in a baseball or softball game having a unique "swing path" or "swing axis," or the direction and angles at which their bats move when attempting to strike a pitch, in almost all cases, a 120° section of the bat will be left untouched by well-struck balls into the field of play. Since the asymmetric knob 24 enables proper orientation of the "hitting" and "non-hitting" zones of the barrel portion 18, the ribs 62 may also be oriented accordingly to ensure increase strength and durability of the knob-handle connection while reducing the overall weight of the knob and handle connection. For example, at least one rib 62 may be oriented to substantially align (e.g., within 5 degrees) with a center of the hitting zone of the barrel portion 18 along the circumferential direction 12*c*.

Of course, while the lightened knob of the present invention applies well to an asymmetric arrangement, it also applies well to a symmetric knob and will provide a lighter know and handle overall. The advantages cross over to most knob arrangements.

Figure 3A:
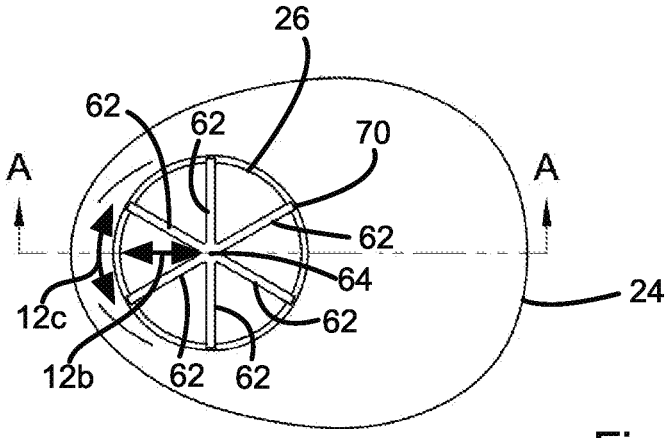
FIG. 3A is a top view of a second lightened knob and insert for a baseball bat in accordance with an embodiment of the present invention.
Figure 3B:
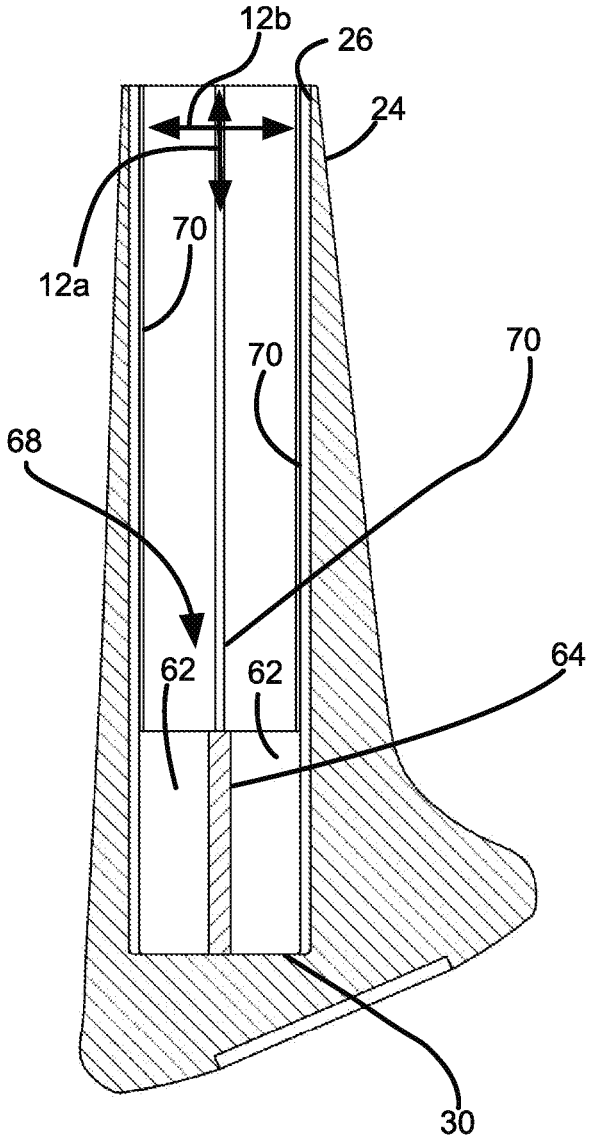
FIG. 3B is a side cross-sectional view of the second lightened knob and insert along section line AA shown in FIG. 3A.
Figure 3C:
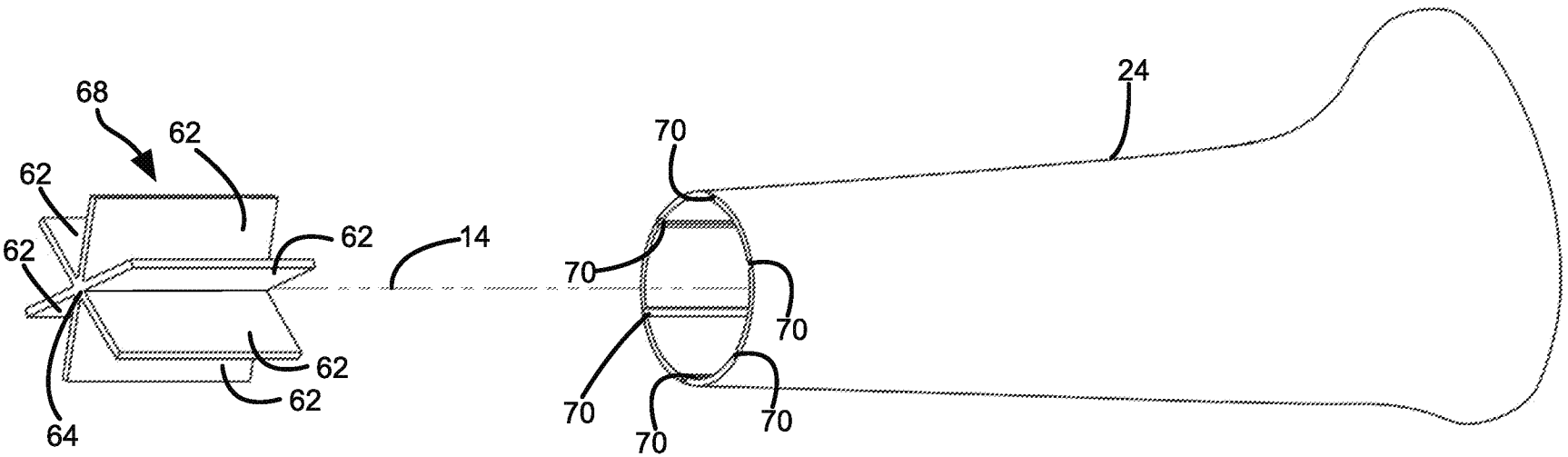
FIG. 3C is an isometric view of the second lightened knob and insert of FIG. 3A.
Figure 4A:
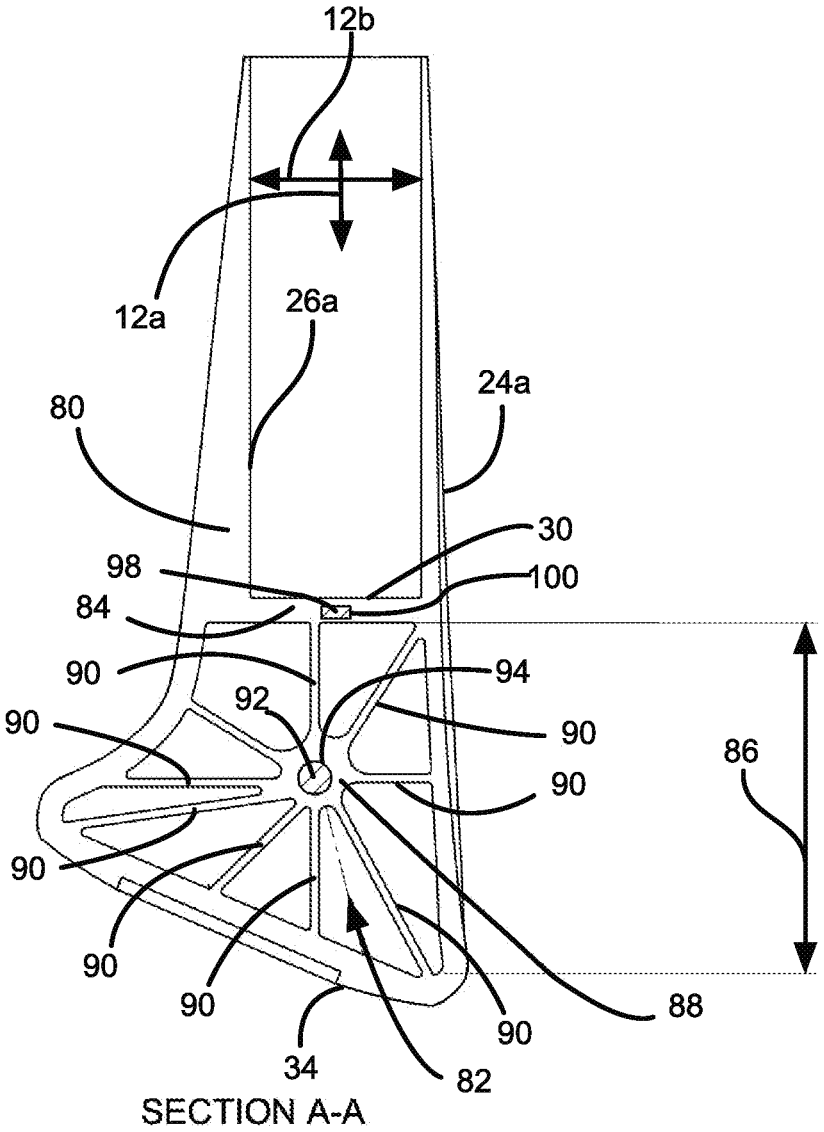
FIG. 4A is a side view of one part of a third lightened knob in accordance with an embodiment of the present invention.
Figure 4B:
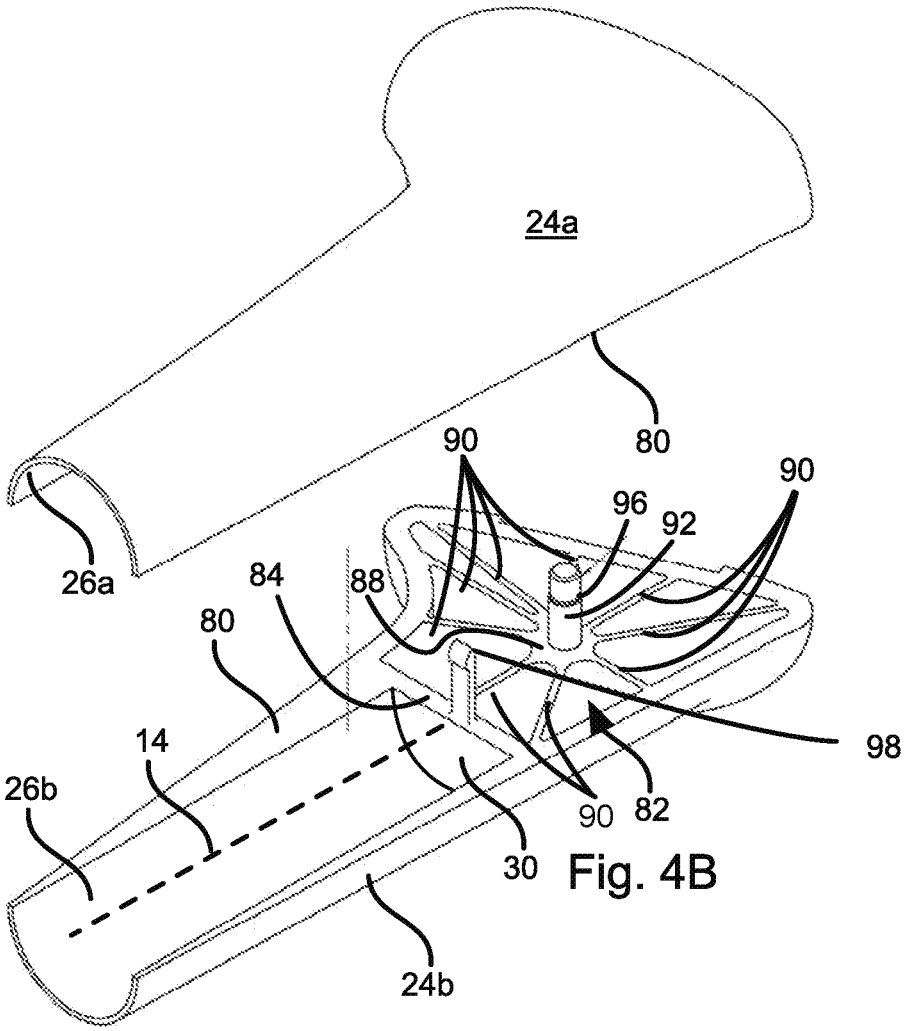
FIG. 4B is an exploded view of the two parts of the third lightened knob of FIG. 4A.
Figure 4C:
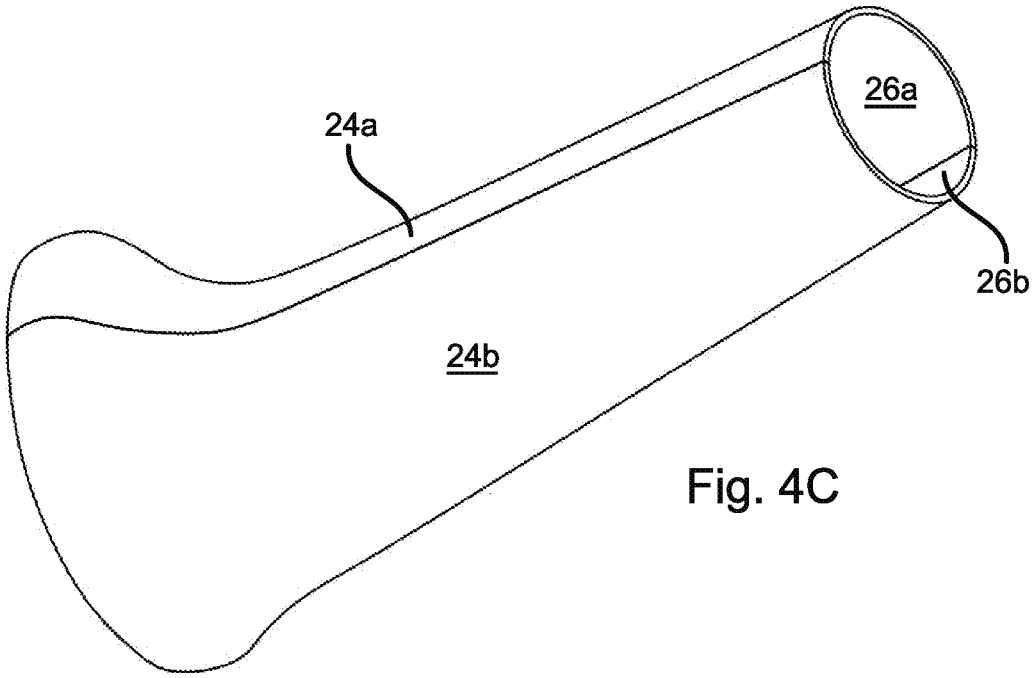
FIG. 4C is an isometric view of the assembled third lightened knob of FIG. 4A.
Figure 4E:
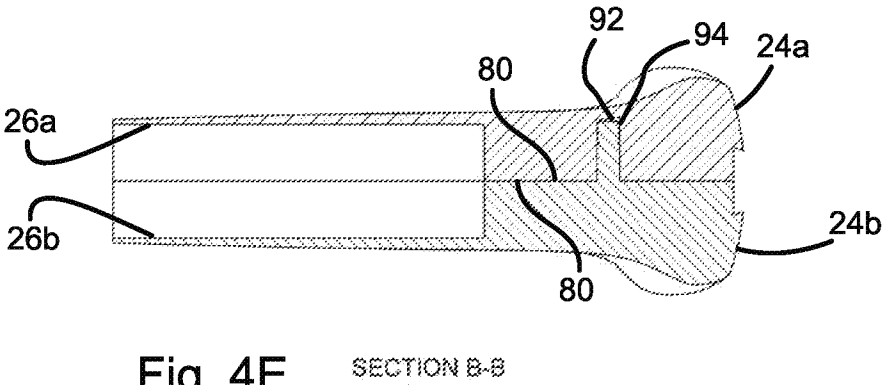
FIG. 4E is a side cross-sectional view of the third lightened knob along section line BB in FIG. 4D.
Figure 4D:
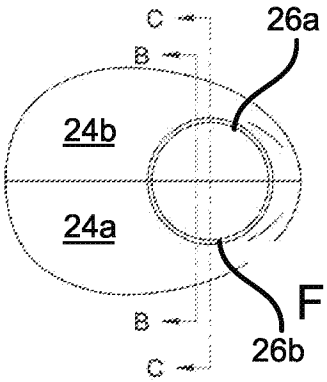
FIG. 4D is a top view of the third lightened knob of FIG. 4A.
Figure 4G:
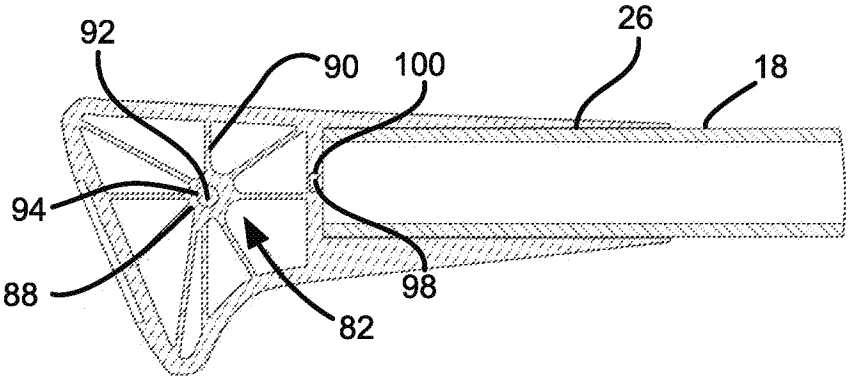
FIG. 4G is a side cross-sectional view of the third lightened knob of FIG. 4A secured to a handle portion of a baseball bat.
Figure 4F:
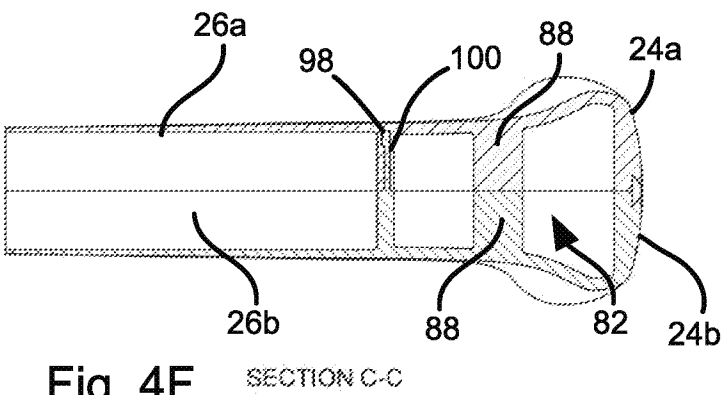
FIG. 4F is a side cross-sectional view of the third lightened knob along section line CC in FIG. 4D.
Figure 4H:
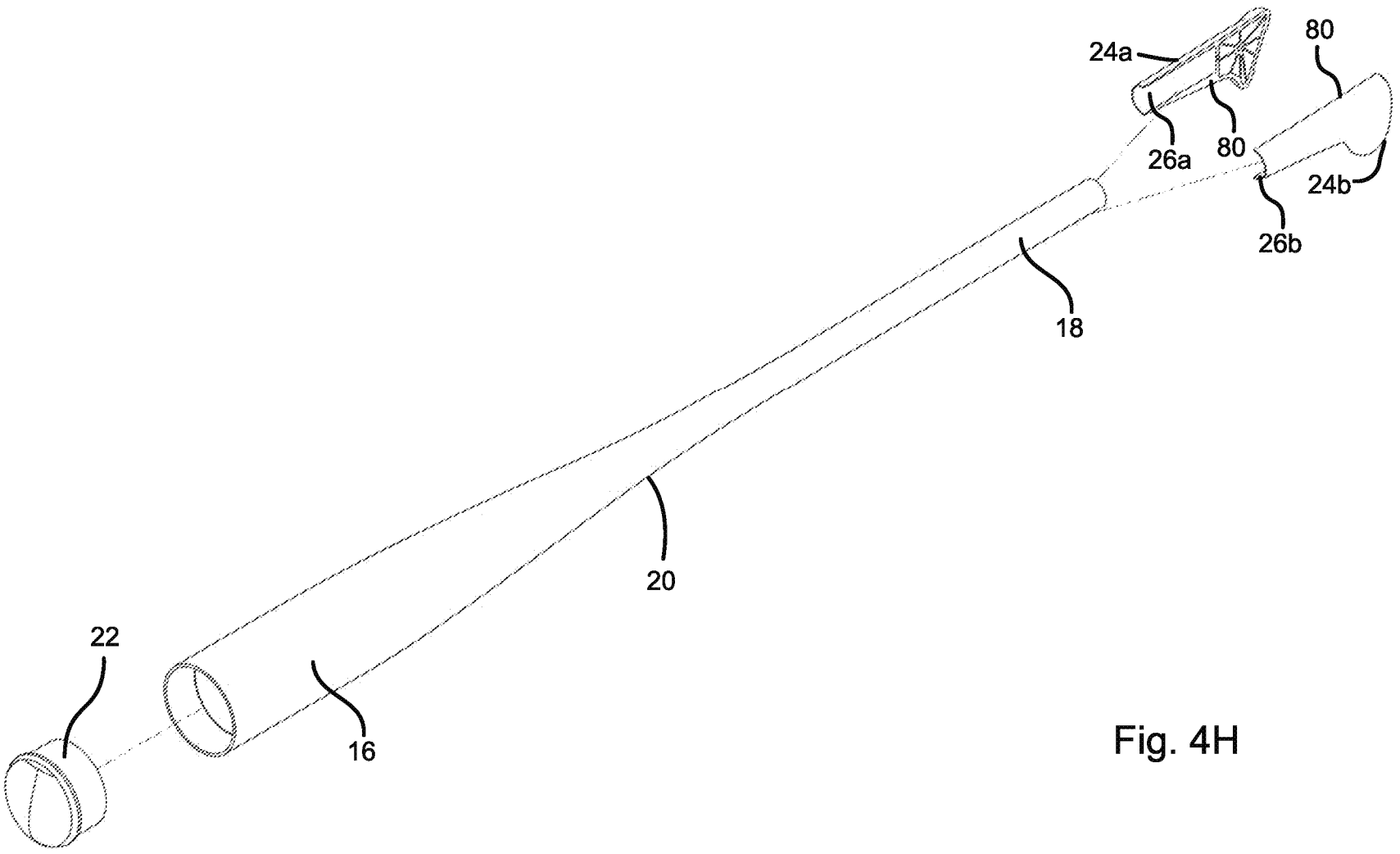
FIG. 4H is an exploded view of the third lightened knob of FIG. 4A and a baseball bat.

Referring to FIGS. 3A, 3B, and 3C, in some embodiments, the ribs 62 and node 64 may be a separate member than the knob 24. For example, the ribs 62 and node 64 having any of the configurations for ribs 62 and a node 64 as described above may be defined by an insert 68. The insert 68 may be manufactured using any of the materials or manufacturing techniques described above as being suitable for manufacture of the knob 24.

In such embodiments, the sleeve 26 may define grooves 70 extending outwardly therefrom and extending from a top of the sleeve 26 to the base 30 of the sleeve 60 parallel to the center line 14. The grooves 70 may be formed during molding of the knob 24 or machined into the sleeve 26 following molding. The number and angular distribution of the grooves 70 about the circumferential direction 12*c* may correspond to the number and angular distribution of the ribs 62. For example, in the illustrated embodiment, there are six ribs 62 and six grooves 70. However, 3, 4, 7, 8 or other number of ribs 62 and grooves 70 may also be used. Accordingly, distal ends of each rib 62 may insert within one of the grooves 70. The ribs 62 and node 64 may then be slid down the grooves 70 to the base 30 of the sleeve 26. The insert 68 may be secured within the grooves 70 due to the handle portion 18 being inserted into the sleeve 26 and secured in place using any of the fastening means described above. In other embodiments, the insert 68 is secured within the grooves by means of adhesive interposed between distal ends of the ribs 62 and the grooves 70. Alternatively, the ribs 62 may have lengths and/or widths that result in an interference fit within the sleeve 26 and the grooves 70 such that the insert 68 is secured within the grooves 70 without use of adhesive. The ribs 62 and node 68 may be structured and oriented in the same manner as for the embodiment of FIGS. 2A and 2B in order to increase stiffness and stability of the knob and to align with the hitting zone of the barrel portion 18.

Referring to FIGS. 4A to 4H, the knob 24 may be divided into two parts 24*a*, 24*b*, such as along a plane of symmetry for the exterior contour of the knob 24. The center line 14 may lie in this plane of division, such as within 1-3 mm of this plane of division. Each part 24*a*, 24*b* may define a surface 80 parallel to the plane of symmetry and which interfaces with the other part when the two parts 24*a*, 24*b* are joined together around the handle portion 18. Adhesive may be applied to the surfaces 80 and to sleeve parts 26*a*, 26*b* of the sleeve 26 defined by the two parts 24*a*, 24*b*. The surfaces 80 may then be pressed together around the handle portion 18 in order to adhere the parts 26*a*, 26*b* to one another around the handle portion 18. Other fastening methods include welds, rivets, or any other fastening means.

In some embodiments, the knob includes a wall defining a base of the sleeve, the wall being positioned between the void and a proximal end of the handle portion. The knob may include a first part and a second part, the first part including a first wall part defining a first void part, the second part including a second wall part defining a second void part, the first and second wall parts defining the wall and the first and second void parts defining the void.

In order to lighten the knob 24, each part 24*a*, 24*b* may define a cavity 82. For example, the base 30 of the sleeve 26 may be defined by cross pieces 84 extending across the sleeve parts 26*a* in the radial and circumferential directions 12*b*, 12*c*. The cross pieces 84 may be offset from the end surface 34 of the knob 24. The cross pieces 84 may be positioned such that the cavities 82 has an extent 86 in the longitudinal direction 12*a*. The extent 86 may be selected in order to provide a degree of lightening of the bat 10.

In some embodiments, the knob 24 formed using the parts 24*a*, 24*b* may be strengthened by internal webs. For example, each part 24*a* may define a node 88 within the cavity 82 with one or more ribs 90 extending outwardly therefrom and connect to sides of the cavity 82. The node 88 and ribs 90 may form part of the surface 80 such that nodes 88 and ribs 90 of one part 24*a* may be secured to those of the other part 24*b* that have a mirror configuration.

In some embodiments, the parts 24*a*, 24*b* of the knob 24 may define structures facilitating alignment of the parts 24*a*, 24*b* with one another during assembly and use. For example, in some embodiments, part 24*b* includes a pin 92, such as a cylindrical pin 92 with a chamfered or beveled end, protruding perpendicularly outwardly from the surface 80. In the illustrated embodiment, the pin 92 protrudes outwardly from the node 88. The part 24*a* may include an opening 94 sized and positioned to receive the pin 92 when the parts 24*a*, 24*b* are placed together. Accordingly, the opening 94 may be defined in the node 88 of the part 24*a*. In some embodiments, the pin 92 may include one or more circumferential grooves 96. These may enhance attachment of the pin 92 within the opening 94. For example, the pin 92 may be made of metal and the one or more grooves 96 may facilitate engagement of the pin 92 with adhesive placed between the pin 92 and the opening 94. Alternatively, or additionally, the pin 92 may engage the opening 94 with an interference fit. A detent may also be defined within the opening 94 and engage the one or more grooves 96.

In some embodiments, a locking tab 98 may be used alone or in combination with the pin 92. In the illustrated embodiment, the locking tab 98 is secured to the cross piece 84 of the part 24*b*. A corresponding opening 100 may be defined in the cross piece 84 of the part 24*a* and be sized to lock with the locking tab 98. Accordingly, the opening 100 may define an internal shoulder for engaging the hook of the locking tab 98. In the illustrated embodiment, the pin 92 and locking tab 98 are on the same part 24*b*. However, in other embodiments, the pin 92 and locking tab 98 may be on different parts 24*a*, 24*b*.

As shown in FIGS. 4C through 4H, the parts 24*a*, 24*b* may be brought together around the handle portion 18, possibly with adhesive applied to the surface 80 of one or both parts 24*a*, 24*b* and one or both of the handle portion 18 and the parts 26*a*, 26*b* of the sleeve 26. The pin 92 inserts within the hole 94 and the locking tab 98 inserts within the opening 100. The surfaces 80 are brought into contact, at which point the locking tab 98 locks within the opening 100.

In some embodiments a knob 24 with an internal cavity 82 and one or more ribs 90 and/or a node 88 may be formed by additive manufacturing (e.g., three-dimensional printing) such that forming the knob 24 as two separate parts 24*a*, 24*b* is not performed.

Figure 5:
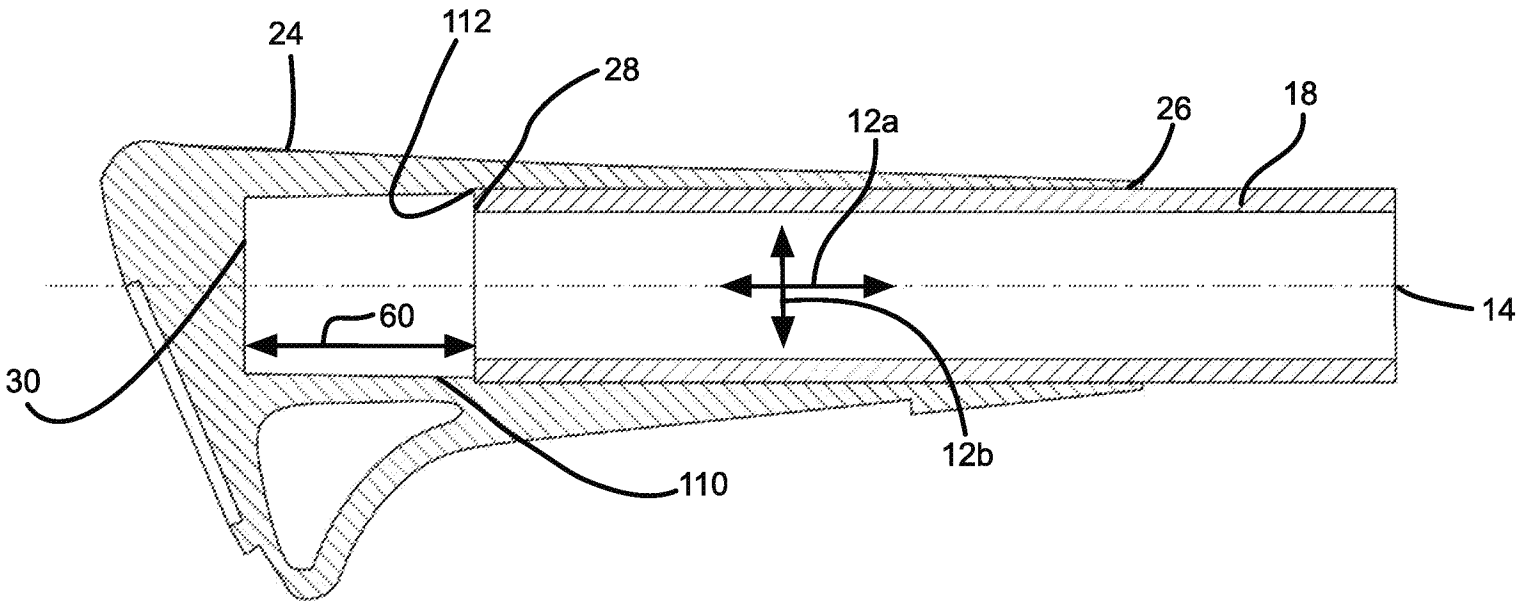
FIG. 5 is a side cross-sectional view of a fourth lightened knob secured to a baseball bat in accordance with an embodiment of the present invention.

FIG. 5 illustrates an alternative approach for creating an empty space within the knob 24. In the illustrated embodiment, the sleeve 26 may extend through the knob 24 to a smaller diameter opening 110 that is concentric around the center line 14. The smaller diameter opening 110 may extend a distance 60 from a base 30 of the cavity defined by the sleeve 26 and a top of the opening 110. For example, the distance 60 may be from 2 to 5 cm. For example, the diameter of the opening 110 may be between 2 and 5 mm smaller than the diameter of the sleeve 26. Accordingly, there may be shoulder 112 at a transition between the sleeve 26 and the smaller diameter opening 110. The proximal end of the handle portion 18 may abut the shoulder 112 such that the volume within the opening 110 remains unoccupied, thereby lightening the bat 10. As for other embodiments, the handle portion 18 may secure within the sleeve 26 by means of an adhesive. As with our description above, other fastening methods may be used.

Figure 6C:
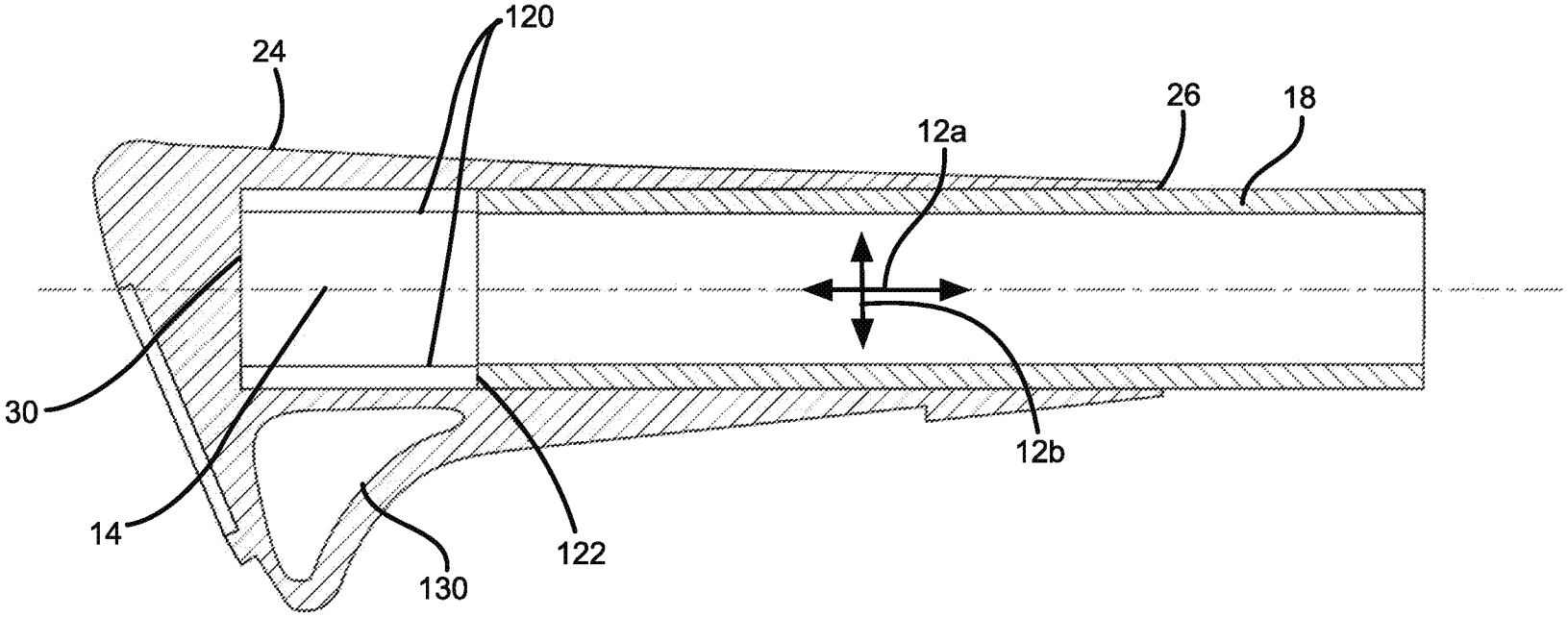
FIG. 6C is another side cross-sectional view of the fifth lightened knob secured to a handle portion of a baseball bat.

FIGS. 6A through 6C illustrate an alternative approach for maintaining an offset between the base 30 of the sleeve 26 and the proximal end 28 of the handle portion 18. In this embodiment, a plurality of projections or protrusions 120 extend inwardly from the sleeve 26 in the radial direction 12*b* toward the center line 14. The projections 120 extend only partially toward the center line 14, e.g. between 2 and 10 percent of a radius of the sleeve 26. The projections 120 may also extend along the longitudinal direction 12*a* and have substantially constant cross section along their lengths in the longitudinal direction 12*a*, terminating in a flat shoulder 122 that is perpendicular to the longitudinal direction 12*a*. The circumferential extent of each projection 120 may be small, e.g. between 2 and 10 degrees about the circumferential direction 12*c*. There may be a plurality of projections 120. In the illustrated embodiment, there are three projections 120, however 2, 4, 5, 6, or other number of projections 120 may be used. The plurality of projections 120 may be distributed uniformly about the circumferential direction 12*c*. These projections 120 need not be structural in this embodiment.

The proximal end of the handle portion 18 may be positioned within the sleeve 26 abutting the shoulders 122 of the projections 120 such that the volume of the sleeve 26 along the projections 120 in the longitudinal direction 12*a* remains unoccupied, thereby lightening the bat 10. As for other embodiments, the handle portion 18 may secure within the sleeve 26 by means of an adhesive. Again here, other fastening methods may be employed.

Figure 7B:
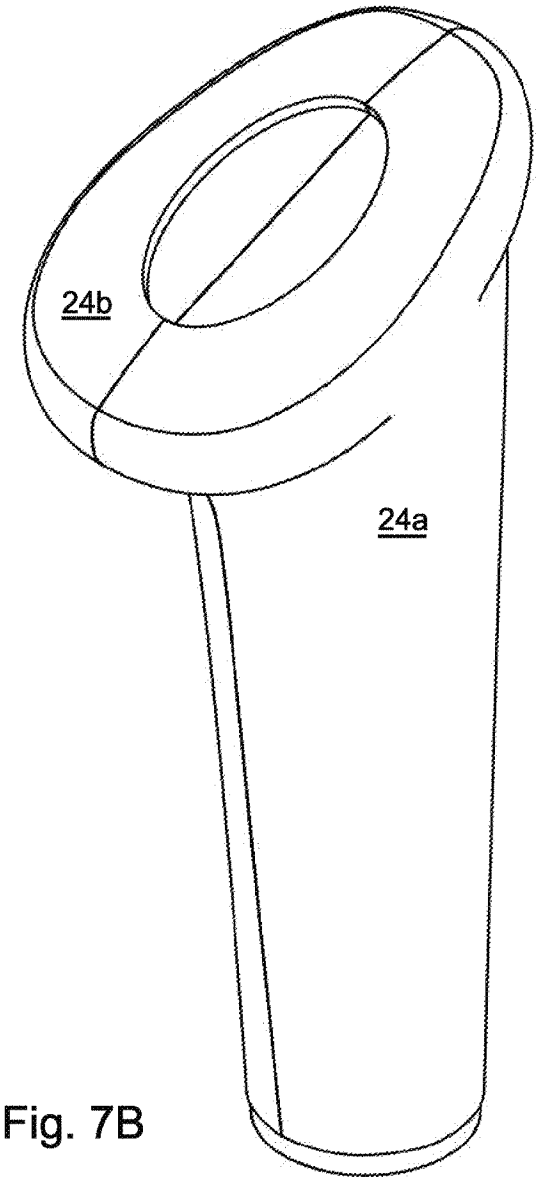
FIG. 7B is an isometric view of the sixth lightened knob of FIG. 7A.
Figure 7A:
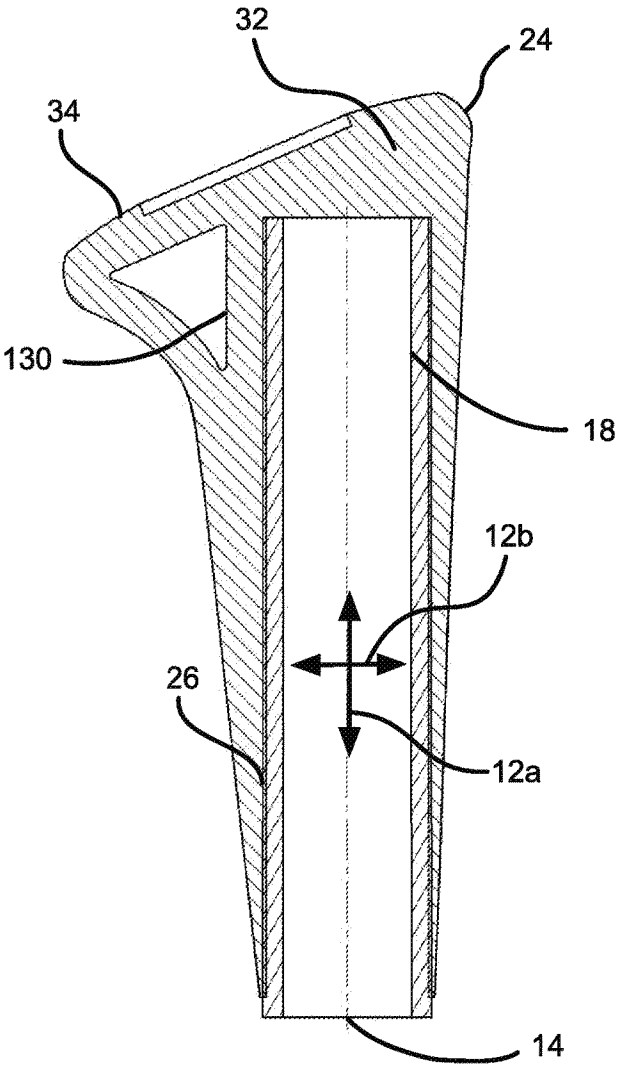
FIG. 7A is a side cross-sectional view of a sixth lightened knob secure to a handle portion of a baseball bat in accordance with an embodiment of the present invention.
Figure 7C:
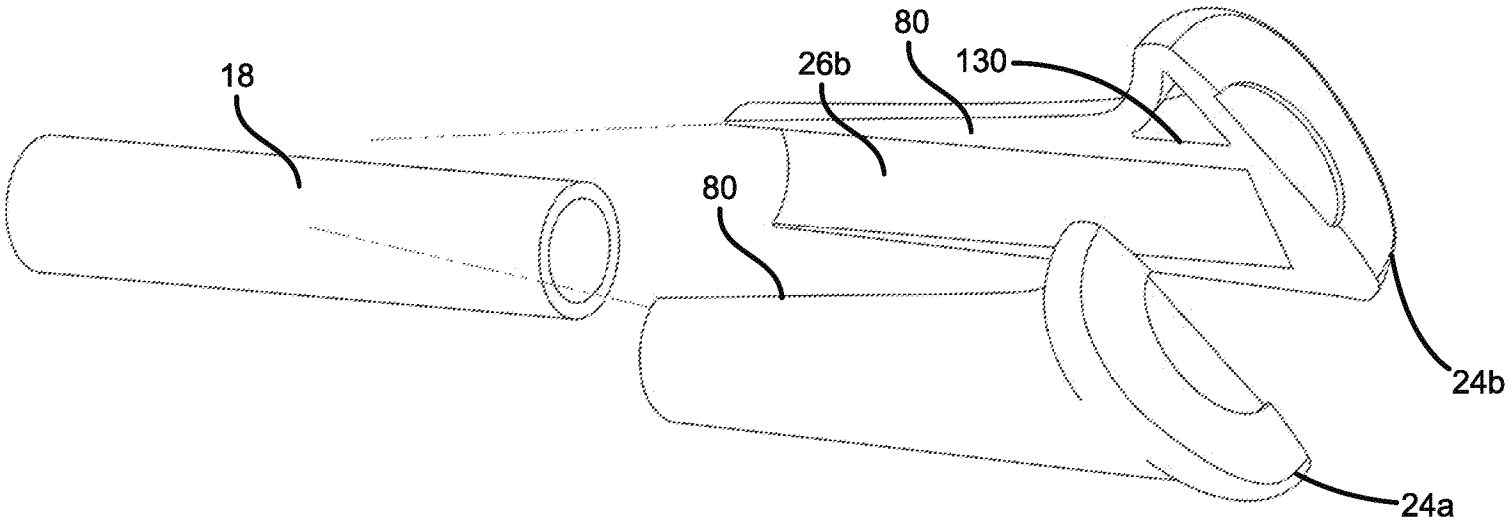
FIG. 7C is an exploded view of the sixth lightened knob of FIG. 7A and a handle portion of a baseball bat.

Referring to FIGS. 7A to 7C, in another implementation the knob 24 is formed of two parts 24*a*, 24*b* each defining a surface 80 that mates with the surface 80 of the other part 24*a*, 24*b*. Adhesive may be applied to the surfaces 80 to secure the two parts 24*a*, 24*b* to one another. As for the embodiment of FIGS. 4A to 4H, the sleeve 26 may be defined by semi-cylindrical sleeve parts 26*a*, 26*b* defined by the two parts 24*a*, 24*b*. Adhesive may be applied to one or both of the handle portion 18 and the sleeve parts 26*a*, 26*b* to secure the handle portion 18 within the sleeve parts 26*a*, 26*b*.

In the illustrated embodiment, one or more voids are defined in the body 32 of the knob 24 around the sleeve 26 defined by the sleeve parts 26*a*, 26*b*. For example, each part 24*a*, 24*b* may define a void part 130, the void parts 130 being connected to one another to form a single void when the parts 24*a*, 24*b* are secured to one another. In the illustrated embodiment, the end face 34 of the knob 24 is angled relative to the center line 14 and the longitudinal direction 12*a*. The knob body 32 includes material projecting outwardly from the sleeve 26 in the radial direction 12*b* and the end face 34 overhangs and overlaps part of the sleeve 26 along the longitudinal direction 12*a*. The voids 130 may be defined in this outwardly projecting material. The voids 130 may be used in combination with any of the other approaches for lightening the baseball bat 10 described herein. Note that in some embodiments, the knob 24 may be formed using an additive manufacturing approach (e.g., three-dimensional printing) such that the voids 130 may be formed in the knob 24 without the first forming the knob 24 as two parts 24*a*, 24*b*.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A ball bat comprising:
a barrel portion;
a handle portion secured to the barrel portion and being concentric with the barrel portion about a central axis and having a smaller diameter than the barrel portion; and
a knob secured to the handle portion and including:
a knob body defining an outer surface;
a sleeve defined within the knob body, at least part of the handle portion being inserted within the sleeve; and
a void defined within the knob body that is not occupied by and not positioned within the at least the part of the handle portion,
wherein the void is positioned between a proximal end of the handle portion and a base of the sleeve along the central axis,
wherein one or more ribs are positioned between the base of the sleeve and the proximal end of the handle portion.

2. The ball bat of claim 1, wherein the one or more ribs comprise a plurality of ribs radiating outwardly from a node positioned on the central axis.

3. The ball bat of claim 2, wherein the plurality of ribs and the node are a separate member from the knob.

4. The ball bat of claim 3, wherein the knob defines a plurality of grooves extending along the sleeve parallel to the central axis, the plurality of ribs being positioned within the plurality of grooves.

5. The ball bat of claim 2, wherein the plurality of ribs and the node are co-molded with the knob.

6. The ball bat of claim 1, further comprising a plurality of protrusions extending inwardly from the sleeve only partially toward the central axis and positioned between the base of the sleeve and the proximal end of the handle portion.

7. The ball bat of claim 1, further comprising a smaller diameter opening defined within the knob, the smaller diameter opening having a diameter about the central axis smaller than a diameter of the sleeve and an outer diameter of the handle portion, the smaller diameter opening defining the void.

8. The ball bat of claim 1, further comprising a wall defining a base of the sleeve, the wall being positioned between the void and a proximal end of the handle portion.

9. The ball bat of claim 8, wherein the knob comprises a first part and a second part, the first part including a first wall part defining a first void part, the second part including a second wall part defining a second void part, the first and second wall parts defining the wall, and the first and second void parts defining the void.

10. The ball bat of claim 9, further comprising a projection extending outwardly from the first part, the second part defining an opening sized to receive the projection.

11. The ball bat of claim 10, wherein the projection is one of a pin and a locking tab.

12. The ball bat of claim 9, further comprising:
a first node positioned within the first void part and a plurality of first ribs extending outwardly from the first node to a perimeter of the first void part; and
a second node positioned within the second void part and a plurality of second ribs extending outwardly from the second node to a perimeter of the second void part.

13. The ball bat of claim 12, further comprising a pin extending outwardly form the first node, the second node defining an opening, the pin being positioned within the opening.

14. The ball bat of claim 13, further comprising a locking tab extending outwardly from the first wall part, the second wall part defining an opening sized to engage the locking tab.

15. The ball bat of claim 1, wherein the void is defined in the knob body offset from the sleeve.

16. The ball bat of claim 15, wherein:
the knob comprises a first part and a second part;
the first part defines a first sleeve part and a first void part offset from one another; and
the second part defines a second sleeve part and a second void part offset from one another, the first sleeve part and the second sleeve part defining the sleeve and the first void part and the second void part defining the void.

17. The ball bat of claim 1, wherein the knob is asymmetrical about the central axis.

18. The ball bat of claim 17, wherein the barrel portion is asymmetrical about the central axis.

19. A ball bat comprising:
a barrel portion;
a handle portion secured to the barrel portion and being concentric with the barrel portion about a central axis and having a smaller diameter than the barrel portion; and
a knob secured to the handle portion, the knob having a knob body and a sleeve, the knob body defining an outer surface, the sleeve being defined within the knob body, at least part of the handle portion being disposed within the sleeve, the knob defining a void within the knob body, the void not being occupied by the part of the handle portion disposed within the sleeve, the void not being positioned within the part of the handle portion disposed within the sleeve,
wherein the sleeve has a base, the handle portion has a proximal portion, and a plurality of protrusions extend inwardly from the sleeve only partially toward the central axis and positioned between the base of the sleeve and the proximal portion of the handle portion.

20. A ball bat comprising:
a barrel portion;
a handle portion secured to the barrel portion and being concentric with the barrel portion about a central axis and having a smaller diameter than the barrel portion;
a knob secured to the handle portion, the knob having a knob body and a sleeve, the knob body defining an outer surface, the sleeve being defined within the knob body, at least part of the handle portion being disposed within the sleeve, the knob defining a void within the knob body, the void not being occupied by the part of the handle portion disposed within the sleeve, the void not being positioned within the part of the handle portion disposed within the sleeve; and wherein the sleeve having an inner diameter, the handle portion having an outer diameter, the void having a diameter that is smaller than the inner diameter of the sleeve and that is smaller than the outer diameter of the handle portion.

* * * * *